United States Patent [19]

Vollan

[11] Patent Number: 4,866,797

[45] Date of Patent: Sep. 19, 1989

[54] SYSTEM FOR SECURING AN I-BEAM TO A SUPPORT PIER

[76] Inventor: Gary L. Vollan, 33320 Mission Trail, Lake Elsinore, Calif. 92331

[21] Appl. No.: 818,280

[22] Filed: Jan. 13, 1986

[51] Int. Cl.[4] ..... E04B 5/58

[52] U.S. Cl. ..... 52/126.6; 52/23

[58] Field of Search ..... 52/126.6, 132, 23, DIG. 11; 248/122, 125, 228, 352, 354.3; 403/387, 405.1, 406.1

[56] References Cited

U.S. PATENT DOCUMENTS

| | | | |
|---|---|---|---|
| 1,460,283 | 6/1923 | Shutsa | 248/228 X |
| 3,828,491 | 8/1974 | Koon et al. | 52/23 |
| 3,830,024 | 8/1974 | Warnke | 52/23 |
| 3,970,278 | 7/1976 | Studer | 248/352 |

FOREIGN PATENT DOCUMENTS

| | | | |
|---|---|---|---|
| 863804 | 5/1941 | France | 52/22 |
| 539544 | 9/1941 | United Kingdom | 248/228 |

*Primary Examiner*—David A. Scherbel
*Assistant Examiner*—Creighton Smith
*Attorney, Agent, or Firm*—Harvey S. Hertz

[57] ABSTRACT

A system for securing an I-beam of a building to a support pier. The bottom horizontal flange of the I-beam is secured between a support and L-shaped clamp. The support includes a horizontal base whose top surface is juxtaposed with the bottom surface of the I-beam horizontal flange. A vertical jack screw extends from the top of the pier and is secured to the bottom surface of the horizontal base of the support. A clamp has a horizontal arm whose bottom surface is adjacent the top surface of the I-beam horizontal flange. The support is adjustably secured to the clamp for preventing movement of the I-beam with respect to the pier.

1 Claim, 1 Drawing Sheet

FIG. 1
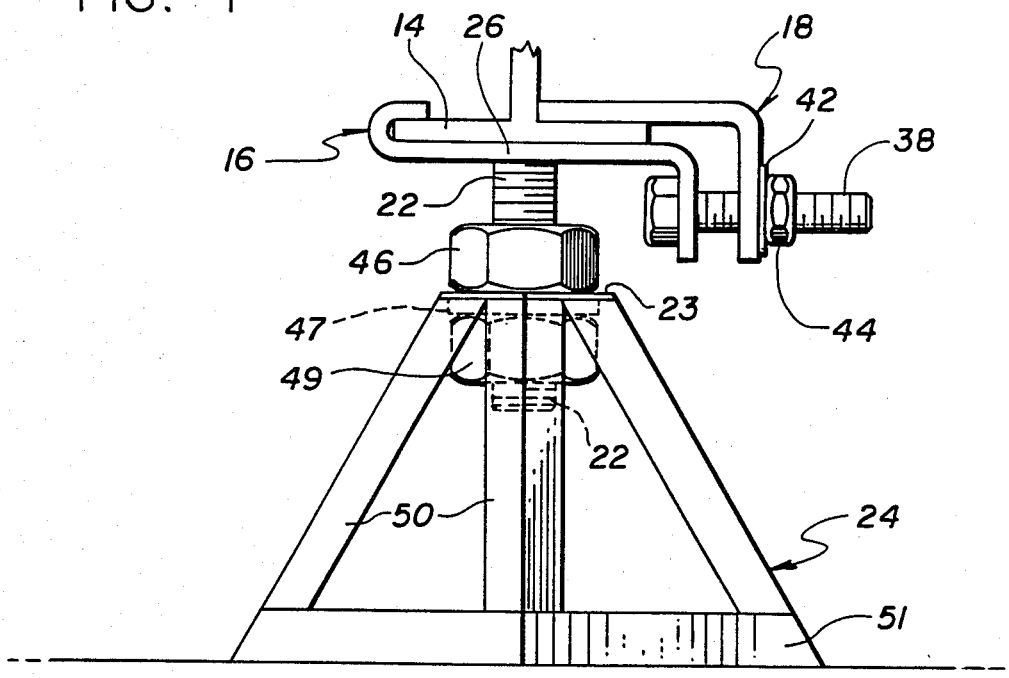
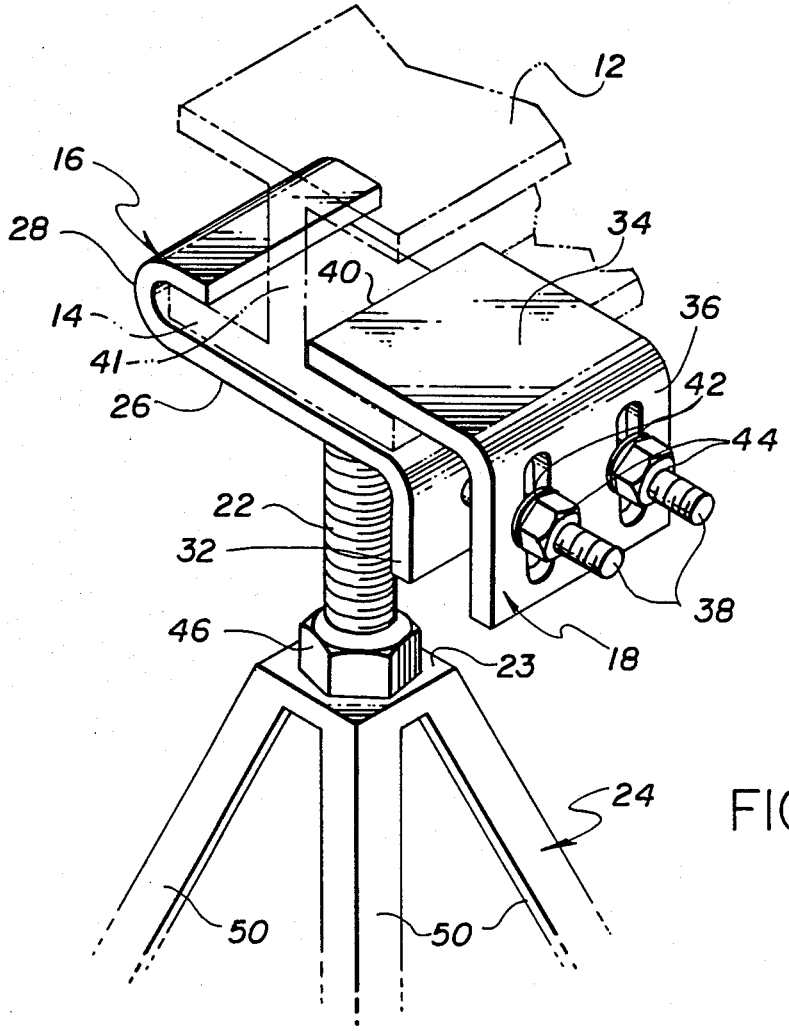
FIG. 2

SYSTEM FOR SECURING AN I-BEAM TO A SUPPORT PIER

BACKGROUND OF THE INVENTION (1) Field of the Invention

The invention relates in general to a securing system between an I-beam and a support pier, and, more particularly, to a system to interconnecting the bottom horizontal flange of an I-beam to a support pier such as the type used as a mobile home support.

(2) Description of the Prior Art

In U.S. Pat. No. 4,404,780 there is described a system for restraining a building, having I-beams secured to the bottom of the building, from moving laterally from a supported position beneath the I-beams. A vertical tongue extends from the top of the pier and are received in vertical sockets secured to the I-beams. However, it has been found that during lateral movement of the building, the vertical tongues will fail causing the I-beams to slip off the pier supports.

Other arrangements for securing I-beams to support piers include using concrete pillars to which the I-beams are secured together with additional strap down devices. However, none of these arrangements have provided sufficient strength to prevent the mobile home mounted on the I-beam to be supported on a pier during lateral mevement such as occurrs during an earthquake.

Other known prior art includes U.S. Pat. Nos. 3,837,127; 3,655,161; 3,724,151; 3,830,457; 4,014,571; 3,830,024 and 3,828,491.

SUMMARY OF THE INVENTION

A system for securing an I-beam of a building to a support pier. The system includes securing the bottom horizontal flange of the I-beam between a support and a L-shaped clamp. The support includes a horizontal base whose top surface is juxtaposed with the bottom surface of the I-beam horizontal flange. A vertical jack screw extends from the top of the pier and is secured to the bottom surface of the horizontal base. The L-shaped clamp has a horizontal arm whose bottom surface is adjacent the top surface of the I-beam horizontal flange. The support is adjustably secured to the clamp for preventing movement of the I-beam with respect to the pier.

The advantages of this invention both as to its description and mode of operation may best be understood by reference to the following detailed description taken in connection with the accompanying drawings in which like reference numerals designate like parts through out the figures.

BRIEF DESCRIPTION OF THE DRAWINGS

FIG. 1 is a perspective view, with a portion of the structure broken away, showing an I-beam mounted on a pier and restrained from lateral movement by the system of the present invention.

FIG. 2 is a perspective view of the securing system.

DESCRIPTION OF THE PREFERRED EMBODIMENT

Referring now to the drawings, there is shown in FIG. 1 the securing system constructed in accordance with the principles of the invention. A conventional I-beam 12 which is used to support a mobile home or other building (not shown) is secured at its bottom horizontal flange 14 to the securing system of the present invention. The securing system of the present invention includes a support 16 and a L-shaped clamp 18. The I-beam bottom horizontal flange 14 is secured between the support 16 and the L-shaped clamp 18.

The support 16 is coupled to the top free end of a vertically adjustable jack screw 22. The other end of jack screw 22 extends through the top plate 23 of a pier 24 which rests on the ground.

It should be noted that although only one pier 24 is illustrated, typically, a number of piers will be utilized to support the I-beam of a conventional mobile home or other building.

Refferring now to FIG. 2, the securing system of FIG. 1 is shown in greater detail. The support 16, upon which the I-beam bottom horizontal flange 14 rests, includes a horizontal base 26 having a U-shaped end 28 at one end thereof and a downwardly extending vertical leg 32 at its other end.

The L-shaped clamp 18 includes a horizontal arm 34 which is intergrally connected to a downwardly extending vertical arm 36. The vertical leg 32 and the vertical arm 36 are spaced from each other and are coupled to each other by means of a pair of transversely extending spaced apart bolts 38. Each bolt 38 includes a washer 42 and a nut 44. The vertical arm 36 contains a pair of slots 45 enabling vertical adjustment of the L-shaped clamp 18 to compensate for varying thickness of the I-beam horizontal flange 14.

The pier 24 is of conventional truncated design and has a nut 46 secured to the top surface of top plate 23. The vertically adjustable jack screw 22 extends through the nut 46 and is intergrally connected at its top end to the bottom surface of the support horizontal base 26. A spacer 47 abuts the bottom surface of top plate 23 and a nut 49 adjacent the spacer secures the jack screw 22 to the pier 24.

The pier 24 includes four downwardly extending legs 50 whose bottom ends are interconnected by a plate 51 (FIG. 1).

In operation, the pier 24 is positioned so that the I-beam bottom horizontal flange 14 rests on the support horizontal base 26, such that the bottom surface of the horizontal flange is juxtaposed with the top surface of the horizontal base. In addition, one edge of the I-beam bottom horizontal flange is positioned within the support U-shaped end 28. Then the L-shaped clamp 18 is adjusted along the axis of the bolts 38 until the free end 40 of the horizontal arm 34 abuts the I-beam vertical web 41. Simultaneously the L-shaped clamp horizontal arm 34 is positioned adjacent the top surface of the I-beam bottom horizontal flange 14.

Once the bottom horizontal flange 14 is correctly positioned between the support 16 and the L-shaped clamp 18, the nuts 44 are tightened and the I-beam 12 is secured so that any lateral movement would not cause the I-beam to slip from the pier 24.

I claim:

1. A system for securing an I-beam of a building to a support pier comprising:

means for securing the bottom horizontal flange of said I-beam between a support and a L-shaped clamp, said I-beam having a pair of horizontal flanges interconnected by a vertical web;

said support including a horizontal base whose top surface is juxtaposed with the bottom surface of said I-beam horizontal flange, said horizontal base having a U-shaped end into which one edge of said I-beam horizontal flange is fitted;

a vertical jack screw extending from the top of the pier and being secured to the bottom surface of said horizontal base;

said L-shaped clamp having a horizontal arm whose bottom surface is positioned adjacent to the top surface of said I-beam bottom horizontal flange, the free end of said horizontal arm abutting the I-beam vertical web; and means for adjustably securing said support to said clamp for preventing movement of said I-beam with respect to said pier, said support and said L-shaped clamp each containing a vertical member formed in parallel planes with respect to each other adjustably movable with respect to each other in both, said parallel planes and in a plane perpendicular to said parallel planes for enabling the system to compensate for differences in the dimensions of said I-beam.

* * * * *